US011098513B2

(12) United States Patent
Liu et al.

(10) Patent No.: US 11,098,513 B2
(45) Date of Patent: Aug. 24, 2021

(54) DOOR AND WINDOW SYSTEM

(71) Applicant: Shenzhen Hopo Window Control Technology Co., Ltd., Shenzhen (CN)

(72) Inventors: Zhiguo Liu, Shenzhen (CN); Zhou Lin, Shenzhen (CN)

(73) Assignee: Shenzhen Hopo Window Control Technology Co., Ltd., Shenzhen (CN)

( * ) Notice: Subject to any disclaimer, the term of this patent is extended or adjusted under 35 U.S.C. 154(b) by 27 days.

(21) Appl. No.: 16/306,027

(22) PCT Filed: Jul. 11, 2016

(86) PCT No.: PCT/CN2016/089695

§ 371 (c)(1),
(2) Date: Nov. 30, 2018

(87) PCT Pub. No.: WO2017/206273

PCT Pub. Date: Dec. 7, 2017

(65) Prior Publication Data

US 2019/0292828 A1 Sep. 26, 2019

(30) Foreign Application Priority Data

Jun. 3, 2016 (CN) ..... 201610390190.1

(51) Int. Cl.
*E05D 15/10* (2006.01)
*E05B 3/00* (2006.01)
(Continued)

(52) U.S. Cl.
CPC ..... *E05D 15/10* (2013.01); *E05B 3/00* (2013.01); *E06B 5/20* (2013.01); *E06B 7/16* (2013.01);
(Continued)

(58) Field of Classification Search
CPC ..... E05D 15/10; E05D 2015/1039; E05D 15/0621
See application file for complete search history.

(56) References Cited

U.S. PATENT DOCUMENTS 3,660,936 A * 5/1972 Bryson ..... E05D 15/10 49/209
5,542,213 A * 8/1996 Freeman ..... E05D 15/10 49/220
(Continued)

FOREIGN PATENT DOCUMENTS

CN 101260770 A 9/2008
CN 203403794 U 1/2014
(Continued)

OTHER PUBLICATIONS

International Search Report and Written Opinion issued by the State Intellectual Property Office of the P.R. China, acting as the ISA, for corresponding international application PCT/CN2016/089695, dated Mar. 15, 2017.

*Primary Examiner* — Gregory J Strimbu
(74) *Attorney, Agent, or Firm* — McCarter & English, LLP

(57) ABSTRACT

A door-and-window system having a handle component (121), a transmission component (123) and a force receiving portion (12231). When the handle component (121) is operated, the force receiving portion (12231) moves along a first guide groove (12211) via the transmission component (123), and at the same time a driving portion (12232) moves along a second guide groove (12221). Due to a relationship between a guide member (1224) and a third guide groove (12212), a first base seat (1221) translates relative to a second base seat (1222) along a direction of the third guide groove (12212), such that a movable door-and-window (11)
(Continued)

can abut tightly against or move away from a sealing member (24) on a door-and-window mounting profile (2).

10 Claims, 13 Drawing Sheets

(51) Int. Cl.
*E06B 5/20* (2006.01)
*E06B 7/16* (2006.01)

(52) U.S. Cl.
CPC . *E05D 2015/1039* (2013.01); *E05Y 2900/132* (2013.01); *E05Y 2900/148* (2013.01)

(56) References Cited

U.S. PATENT DOCUMENTS 6,497,072 B2 * 12/2002 Fries ..... E05B 65/08 49/146
10,077,594 B2 * 9/2018 Fingerle ..... E05D 15/10
2007/0234644 A1 * 10/2007 Jaeger ..... E05F 15/652 49/362
2009/0038228 A1 * 2/2009 Lee ..... E06B 3/4627 49/360
2015/0052819 A1 * 2/2015 Lee ..... E05D 15/0665 49/420

FOREIGN PATENT DOCUMENTS

| | | | |
|---|---|---|---|
| CN | 104863460 | A | 8/2015 |
| CN | 204920538 | U | 12/2015 |
| CN | 204920573 | U | 12/2015 |
| CN | 105492713 | A | 4/2016 |
| CN | 205669367 | U | 11/2016 |
| CN | 205669368 | U | 11/2016 |
| CN | 205805165 | U | 12/2016 |
| KR | 10-0671256 | B1 | 1/2007 |

* cited by examiner

DOOR AND WINDOW SYSTEM

CROSS-REFERENCE TO RELATED APPLICATIONS

This application is a U.S. national phase application of PCT Patent Application Serial No. PCT/CN2016/089695, filed Jul. 11, 2016, and claims priority to and the benefit of Chinese Patent Application No. 201610390190.1, filed Jun. 3, 2016 before the State Intellectual Property Office of P.R. China, which are incorporated herein by reference in their entireties.

TECHNICAL FIELD

The present application relates to the technical field of door-and-window, and in particular, to a door-and-window system.

BACKGROUND

At present, a door-and-window system typically includes a movable door-and-window subsystem and a door-and-window mounting profile, where the door-and-window mounting profile is further mounted with a fixed door-and-window. The movable door-and-window subsystem includes a movable door-and-window and a movable door-and-window transmission subsystem, the movable door-and-window transmission subsystem including a handle component, a movable door-and-window assembly component, and a transmission component. The door-and-window mounting profile includes a main body, and a rail disposed on the main body and configured for the movable door-and-window to move on. Typically, when operating the movable door-and-window subsystem of the door-and-window system, a user pulls the handle component to enable the movable door-and-window to move along the rail, and then rotates the handle component to lock or unlock the movable door-and-window subsystem with or from the door-and-window mounting profile.

The prior art can only provide for the movable door-and-window to move along the rail, but cannot guarantee the sealing performance between the movable door-and-window subsystem and the door-and-window mounting profile. Thus, noise cannot be effectively reduced, and the anti-shock performance is also insufficient.

SUMMARY

The present application aims to solve to a certain degree at least one of the above technical problems.

The present application provides a door-and-window system, including: a movable door-and-window subsystem and a door-and-window mounting profile.

The movable door-and-window subsystem includes a movable door-and-window and a movable door-and-window transmission subsystem.

The movable door-and-window transmission subsystem includes a handle component, a movable door-and-window assembly component and a transmission component.

The door-and-window mounting profile includes:

a main body, a rail disposed on the main body for the movable door-and-window to move on, and a sealing member mounting portion disposed on the main body and spaced apart from the rail by a predetermined distance.

The movable door-and-window assembly component includes:

a first base seat, a second base seat, a driving member, and a guide member, where the first base seat is configured to be assembled with the movable door-and-window and the second base seat is configured to be movably assembled with the rail, or the second base seat is configured to be assembled with the movable door-and-window and the first base seat is configured to be movably assembled with the rail.

The first base seat is provided with a first guide groove parallel to the rail. The second base seat is provided with a second guide groove at a predetermined first angle with the first guide groove. The driving member includes a force receiving portion movably disposed in the first guide groove, a driving portion movably disposed in the second guide groove, and a driving shaft. The force receiving portion and the driving portion are disposed on different sides of the driving shaft.

The first base seat is provided with a third guide groove that is perpendicular to a plane where the movable door-and-window lies in and that forms a predetermined second angle with the second guide groove, and the guide member is movably disposed in the third guide groove with one end of the guide member fixed to the second base seat. Alternatively, the second base seat is provided with a third guide groove that is perpendicular to the plane where the movable door-and-window lies in and that forms the second angle with the second guide groove, and the guide member is movably disposed in the third guide groove with one end of the guide member fixed to the first base seat.

The driving member, the guide member, and the first base seat are set fast relative to the second base seat are along a direction perpendicular to a plane determined by the first guide groove and the third guide groove.

The transmission component is assembled with the handle component and the force receiving portion, respectively.

Further, the transmission component may include a plurality of transmission rods assembled with the force receiving portion, and a conversion member that conducts force transmission between two transmission rods that are oppositely disposed and that extend in different directions.

Further, the conversion member may include an angular actuator configured for conducting force transmission between two transmission rods that run perpendicular to each other, and/or a translation actuator configured for conducting force transmission between two transmission rods that run parallel to each other.

Further, the handle component may include: a handle and an actuator assembled with each other. The movable door-and-window transmission subsystem may further include: a lock disposed on the side of the handle component and/or on the side of the movable door-and-window opposite to the handle component, and disposed between two of the transmission rods.

Further, the second base seat may be provided with a bearing rotating shaft, and a rolling bearing that includes an inner ring sleeved on the bearing rotating shaft and an outer ring abutting against the first base seat, where the rolling bearing is axially parallel to the rail. Alternatively, the first base seat may be provided with a bearing rotating shaft, and a rolling bearing that includes an inner ring sleeved on the bearing rotating shaft and an outer ring abutting against the second base seat, where the rolling bearing is axially parallel to the rail.

Further, the first base seat or the second base seat may be provided with a support piece that abuts against the outer ring of the rolling bearing.

Further, the force receiving portion may be disposed on the side of the first guide groove opposite to the second base seat and has a larger size than the first guide groove. The driving shaft extends through the first guide grieve. The driving portion is disposed on the side of the first guide groove opposite to the first base seat and has a larger size than the first guide groove.

Further, when the first base seat is provided with the third guide groove, one end of the guide member extends through the third guide groove and is then fixed to the second base seat, and the other end of the guide member is disposed on the side of the third guide groove opposite to the second base seat and has a larger size than the third guide groove.

Further, when the second base seat is provided with the third guide groove, one end of the guide member extends through the third guide groove and is then fixed to the first base seat, and the other end of the guide member is disposed on the side of the third guide groove opposite to the first base seat and has a larger size than the third guide groove.

A gasket is disposed between the end of the guide member having a larger size than the third guide groove and the third guide groove.

Further, when the second base seat is configured to be movably assembled with the rail, the second base seat is provided with a bearing wheel rotating shaft, and a bearing wheel that is sleeved on the bearing wheel rotating shaft and that abuts against the rail, with the bearing wheel is axially perpendicular to the rail; otherwise when the first base seat is configured to be movably assembled with the rail, the first base seat is provided with a bearing wheel rotating shaft, and a bearing wheel that is sleeved on the bearing wheel rotating shaft and that abuts against the rail, with the bearing wheel axially perpendicular to the rail.

Further, the first base seat and/or the second base seat may be provided with a mounting portion, a guide shaft, and a guide portion, where the guide portion is assembled with the mounting portion via the guide shaft and is movably assembled with the rail. The guide portion and/or the driving portion may be a wheel body, and the wheel body is rotatable around the guide shaft or the driving shaft. When the second base seat is configured to be movably assembled with the rail, a washer is further disposed between the bearing wheel and the second base seat; and when the first base seat is configured to be movably assembled with the rail, the washer is further disposed between the bearing wheel and the first base seat.

The present application has the beneficial effects described below.

A door-and-window system is provided in which the handle component is assembled via the transmission component with the force receiving portion of the movable door-and-window assembly component. When the handle component is operated, the force receiving portion would move along the first guide groove thanks to the force transmission effect implemented by the transmission component, and at the same time the driving portion would move along the second guide groove. Thus, due to the assembly relationship between the guide member and the third guide groove, the first base seat would translate relative to the second base seat along the direction of the third guide groove, such that the movable door-and-window can abut tightly against or move away from the sealing member on the door-and-window mounting profile. As such, while operating the handle for locking or unlocking, scaling or unsealing between the movable door-and-window subsystem and the door-and-window mounting profile can be achieved, and noise can be effectively reduced, and the anti-shock performance can also be improved.

DETAILED DESCRIPTION OF ILLUSTRATED EMBODIMENTS

Figure 1:
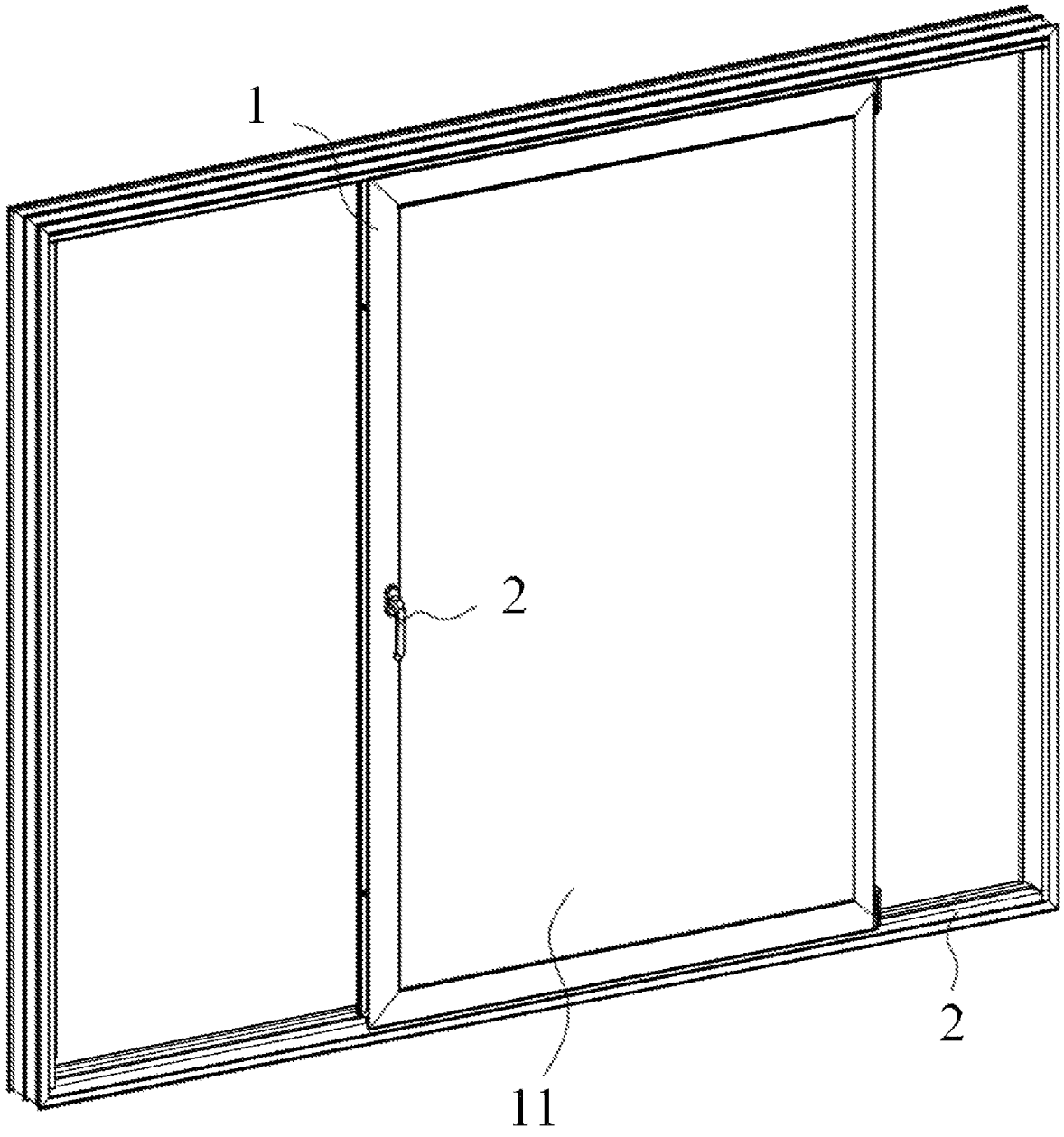
FIG. 1 is a schematic diagram illustrating a door-and-window system according to Embodiment 1 of the present application.

Embodiments of the present application are described below in detail, and examples of these embodiments are illustrated in the drawings, where the same or similar reference numerals indicate the same or similar elements or elements serving the same or similar functions. The embodiments described below with reference to the drawings are exemplary only, intended to explain the present application, and thus should not be construed as limiting the present application.

In the description of the present application, it is to be understood that the directional or positional relationships specified by terms "center", "longitudinal", "lateral", "length", "width", "thickness", "above", "below", "front", "back"," "left", "right", "vertical", "horizontal", "top", "bottom", "inside", "outside", "clockwise", "counterclockwise", etc. are based on the directional or positional relationships illustrated in the drawings. Namely, they are for the mere purpose of facilitating and simplifying the description of the present application, and do not indicate or imply that the apparatus or element referred to has a specific orientation and is constructed and operated in a specific orientation. Thus, they are not to be construed as limiting the present application.

Furthermore, terms like "first" and "second" are intended for description purposes only and are not to be construed as indicating or implying relative importance or implicitly indicating the number of technical features specified. Thus, a feature defined by terms "first" or "second" may explicitly or implicitly include one or more of such feature. As used herein, the term "plurality" means two or more, unless otherwise expressly specified and defined.

In the present application, unless otherwise expressly specified and defined, terms like "mounted", "connected to each other", "connected", or "fixed" are to be construed in a broad sense. For example, they should be construed as: permanently connected, detachably connected or integrated; mechanically connected or electrically connected; directly connected or indirectly connected via an intermediate medium; or internally connected between two elements. For those of ordinary skill in the art, the above terms can be construed based on specific contexts in this application.

In the present application, unless otherwise expressly specified and defined, when a first feature is described as "above" or "below" a second feature, the first feature and the second feature may be in direct contact, or may be in contact via another feature between these two features. Likewise, when a first feature is described as "on", "above", or "over" a second feature, the first feature can be situated right on, above, or over the second feature, or the first feature can be situated obliquely on, above or over the second feature, or the first feature can be situated at a higher level than the second feature. When the first feature is described as "under", "below", or "underneath" the second feature, the first feature can be situated right under, below or underneath the second feature, or the first feature can be situated obliquely under, below or underneath the second feature, or the first feature can be situated at a lower level than the second feature.

The present application will now be described in greater detail taken in conjunction with the drawings and specific embodiments.

Embodiment 1

As shown in FIG. 1, an embodiment provides a door-and-window system, including: a movable door-and-window subsystem 1 and a door-and-window mounting profile 2.

The movable door-and-window subsystem 1 includes: a movable door-and-window 11 and a movable door-and-window transmission subsystem 12.

Figure 2:
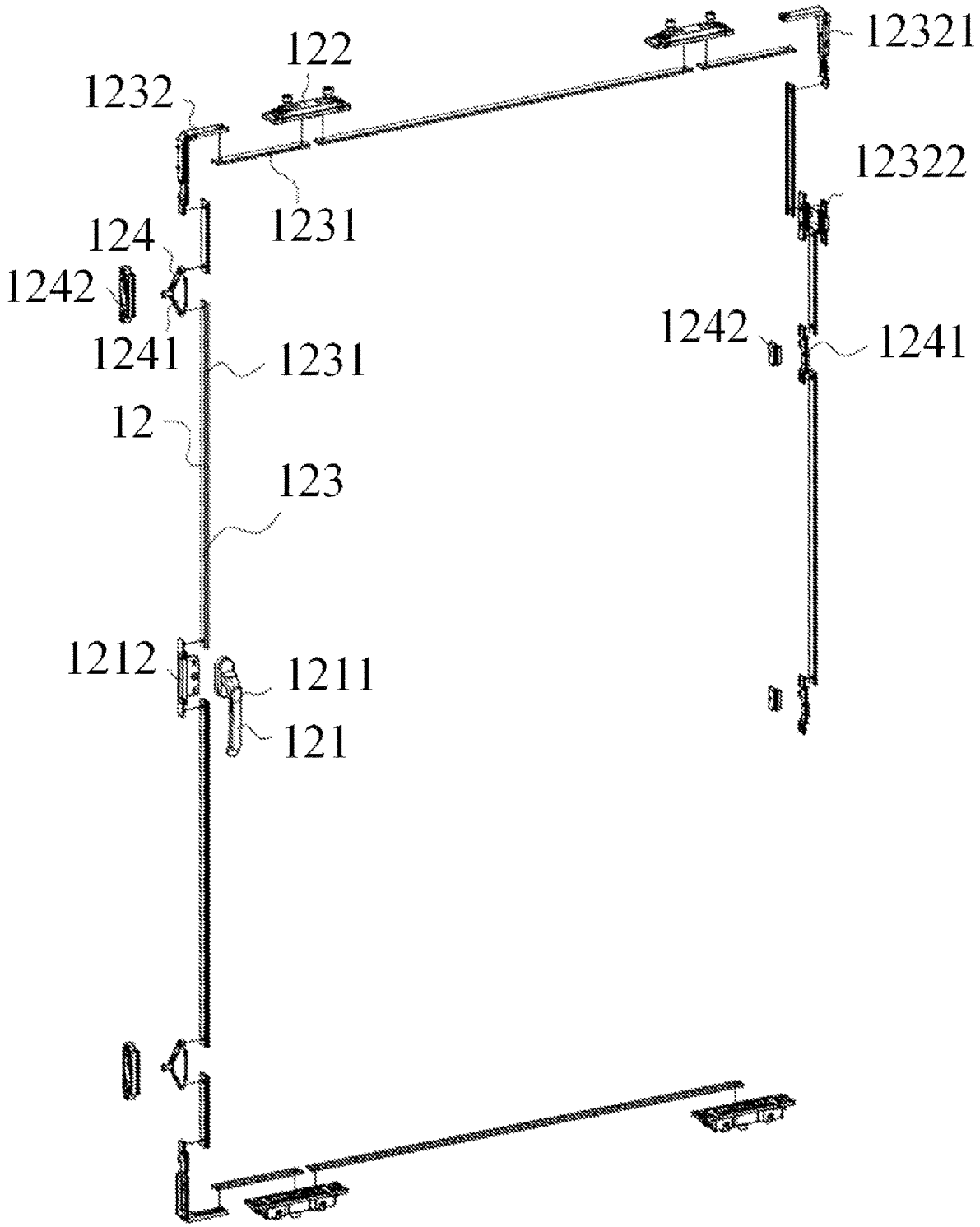
FIG. 2 is a schematic diagram illustrating a movable door-and-window transmission subsystem according to Embodiment 1 of the present application.
Figure 3:
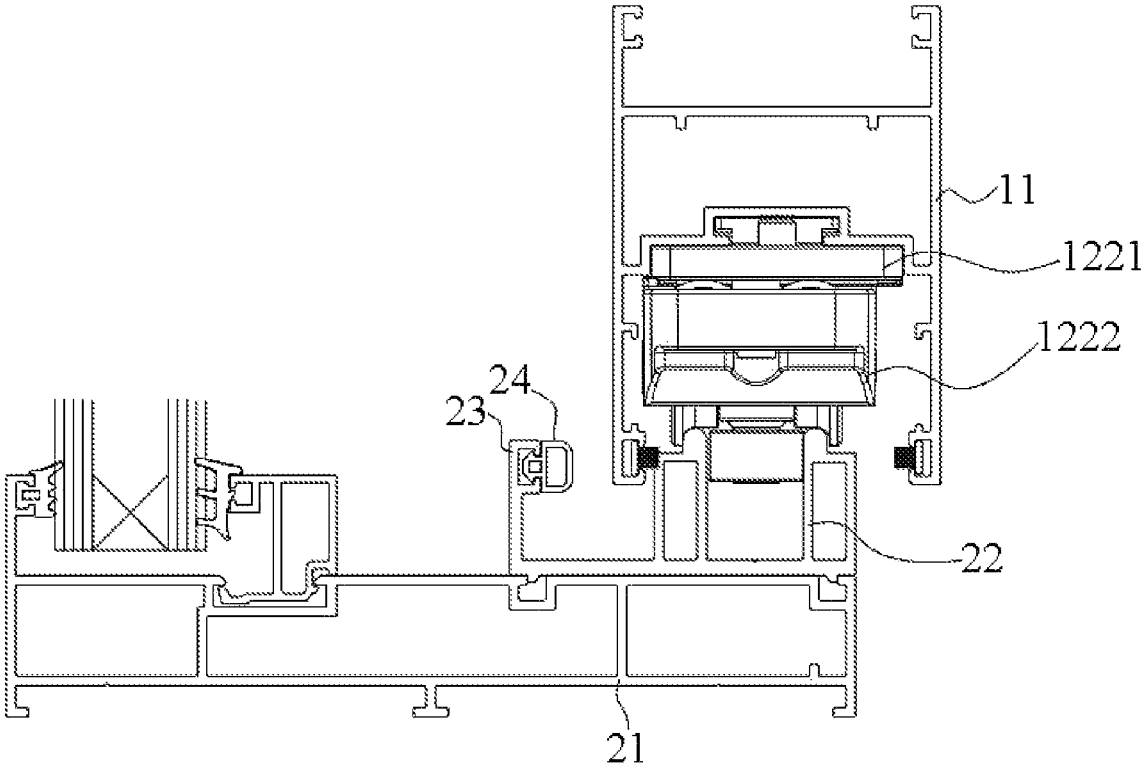
FIG. 3 is a first assembly schematic diagram illustrating a door-and-window mounting profile and a movable door-and-window assembly component below a movable door-and-window according to Embodiment 1 of the present application.
Figure 4:
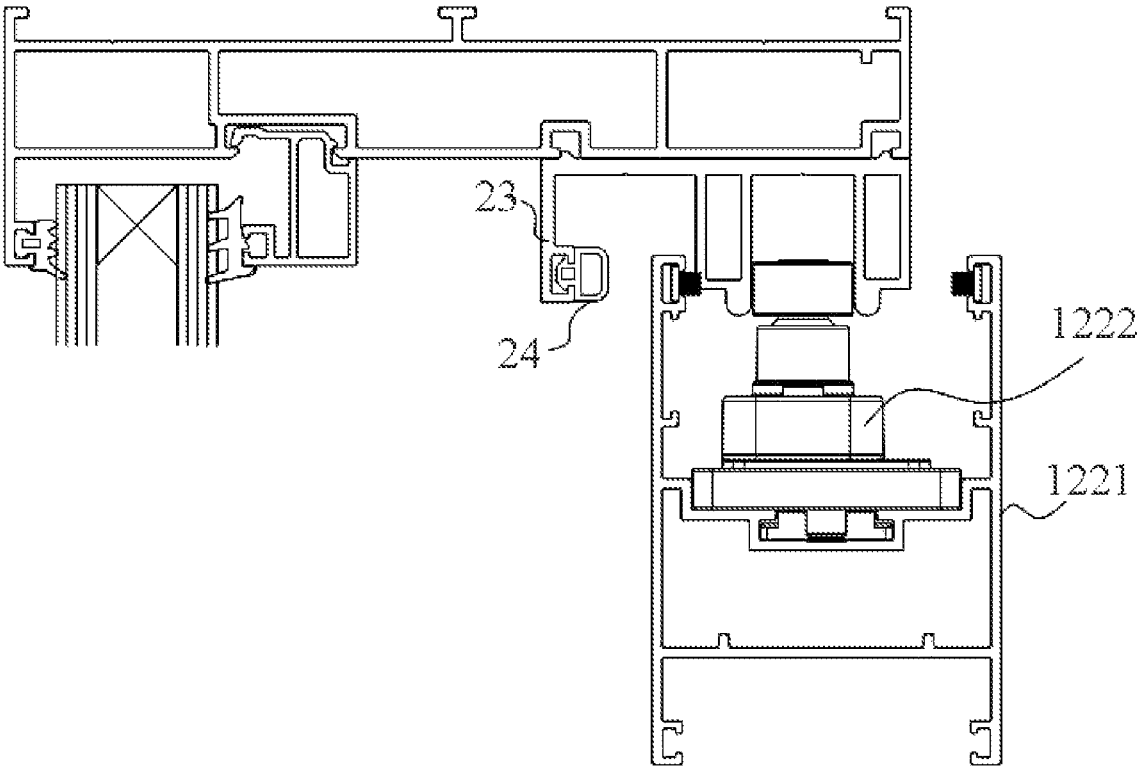
FIG. 4 is a first assembly schematic diagram illustrating the door-and-window mounting profile and a movable door-and-window assembly component above the movable door-and-window according to Embodiment 1 of the present application.
Figure 5:
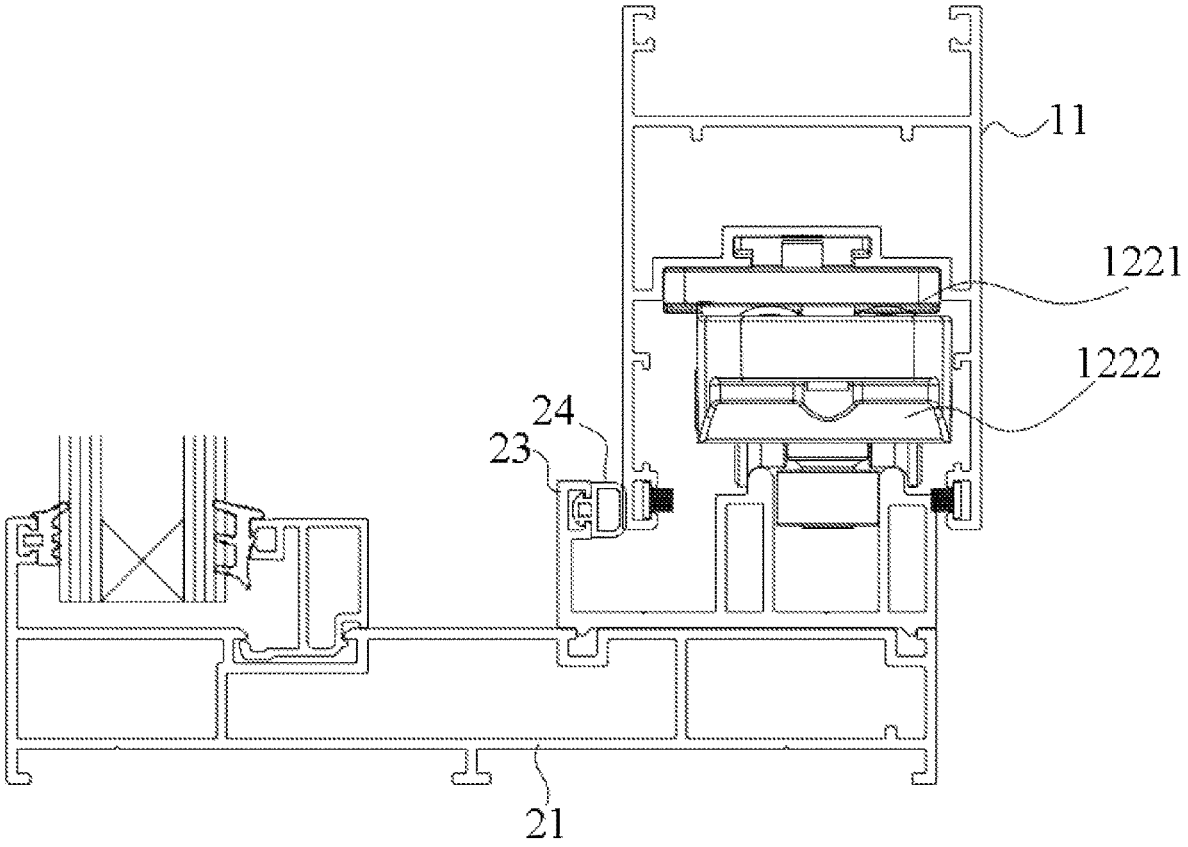
FIG. 5 is a second assembly schematic diagram illustrating the door-and-window mounting profile and the movable door-and-window assembly component below the movable door-and-window according to Embodiment 1 of the present application.
Figure 6:
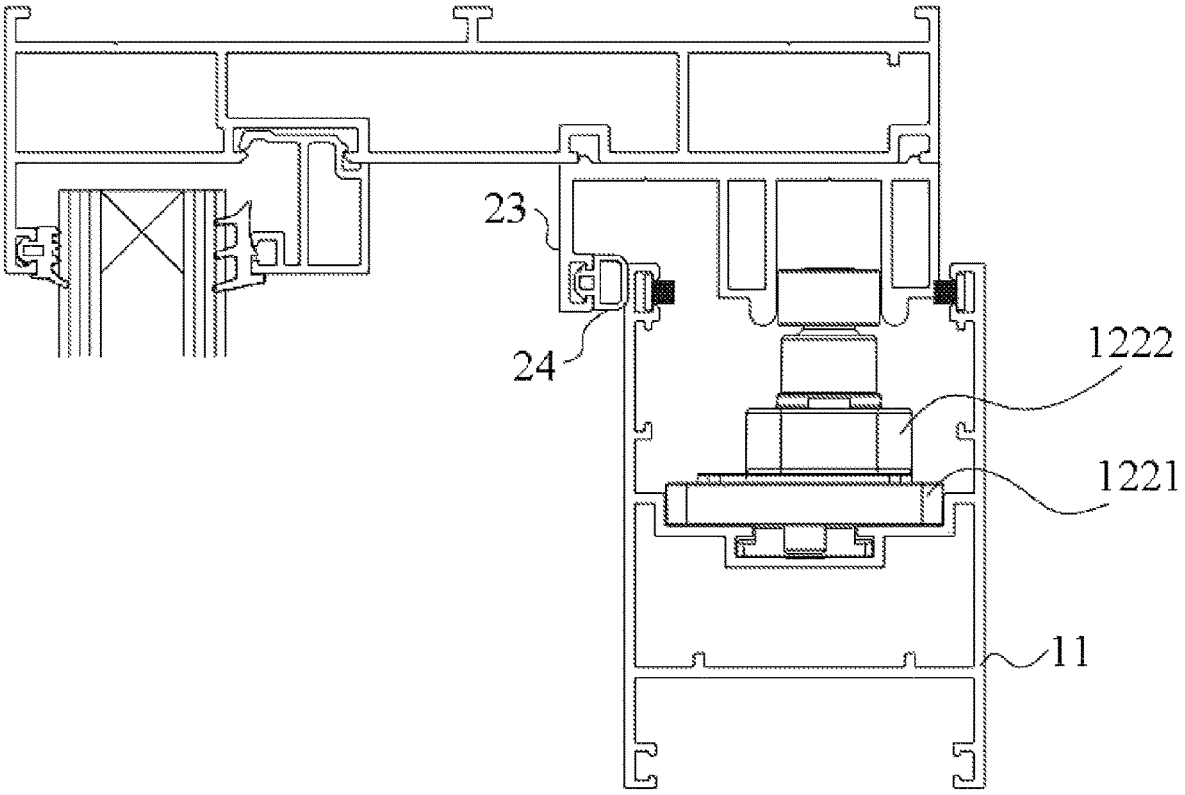
FIG. 6 is a second assembly schematic diagram illustrating the door-and-window mounting profile and the movable door-and-window assembly component above the movable door-and-window according to Embodiment 1 of the present application.
Figure 7:
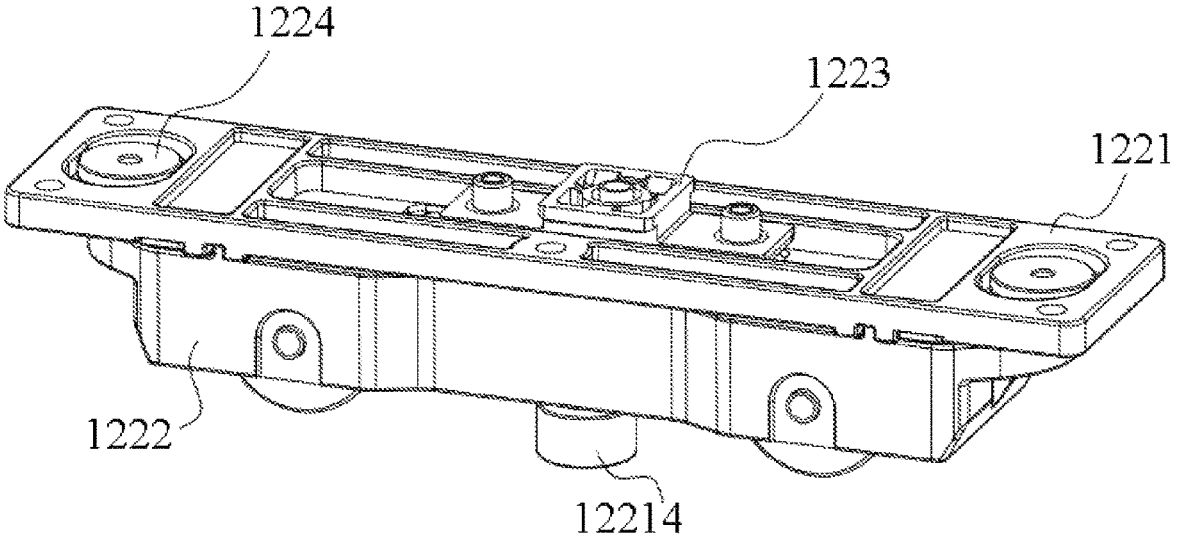
FIG. 7 is a perspective view of the movable door-and-window assembly component below the movable door-and-window according to Embodiment 1 of the present application.
Figure 8:
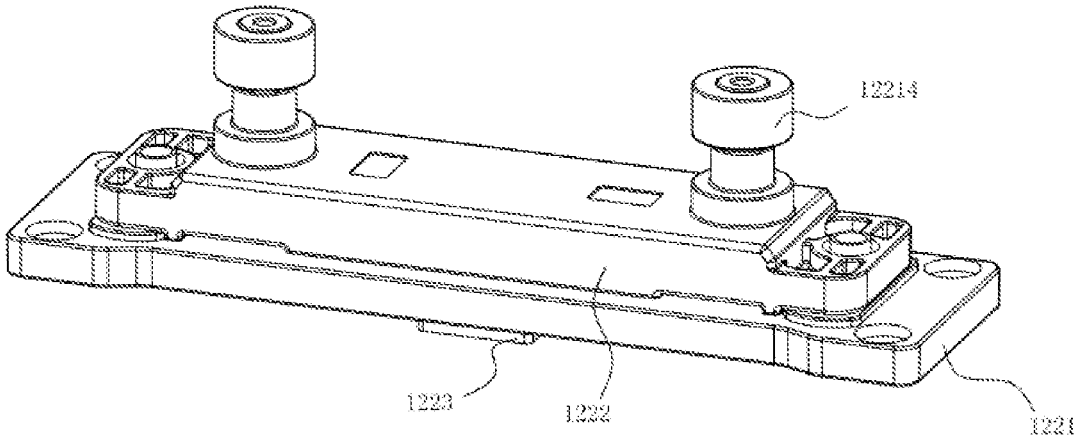
FIG. 8 is a perspective view of the movable door-and-window assembly component above the movable door-and-window according to Embodiment 1 of the present application.
Figure 9:
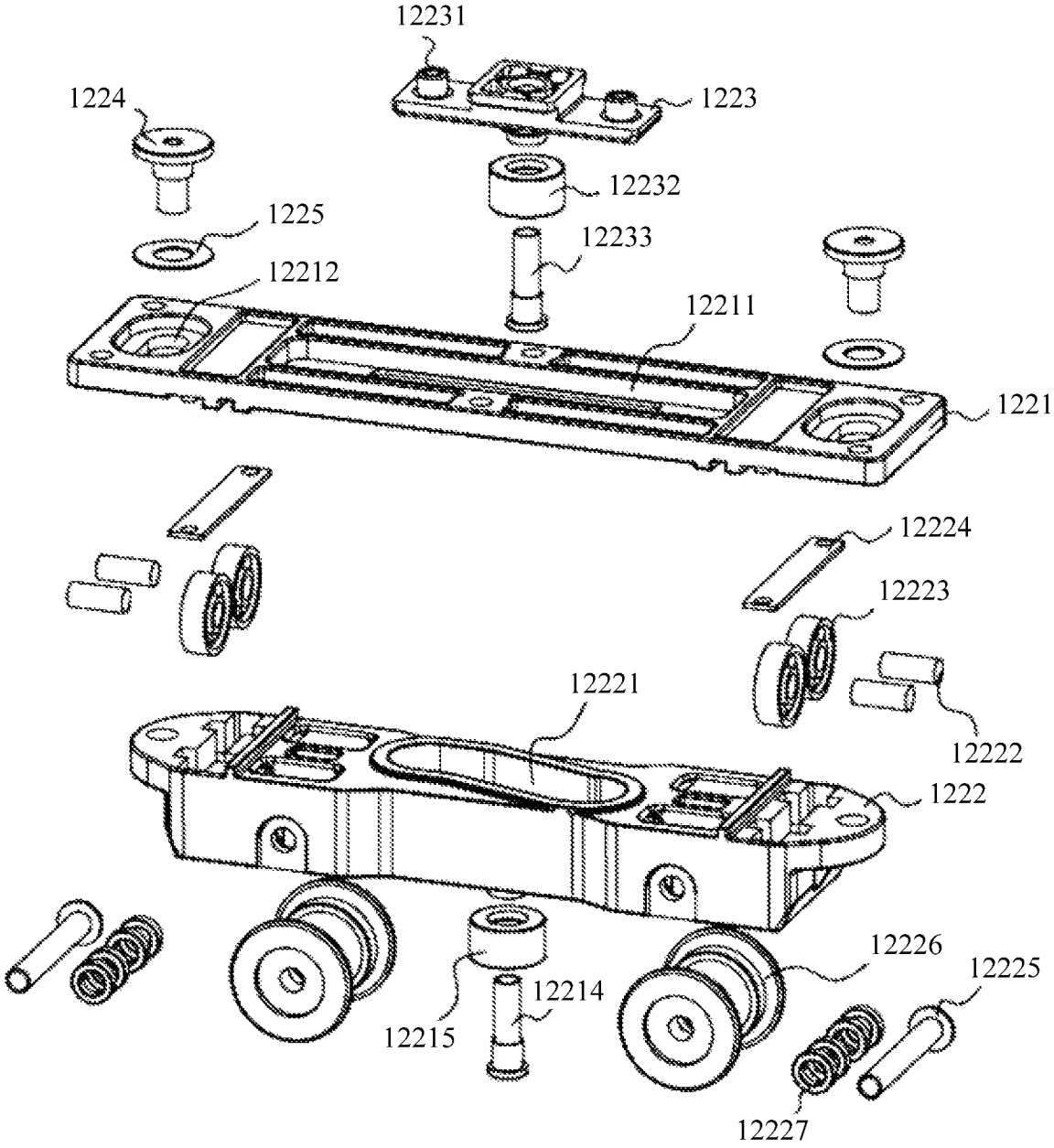
FIG. 9 is an exploded diagram illustrating the movable door-and-window assembly component below the movable door-and-window according to Embodiment 1 of the present application.
Figure 10:
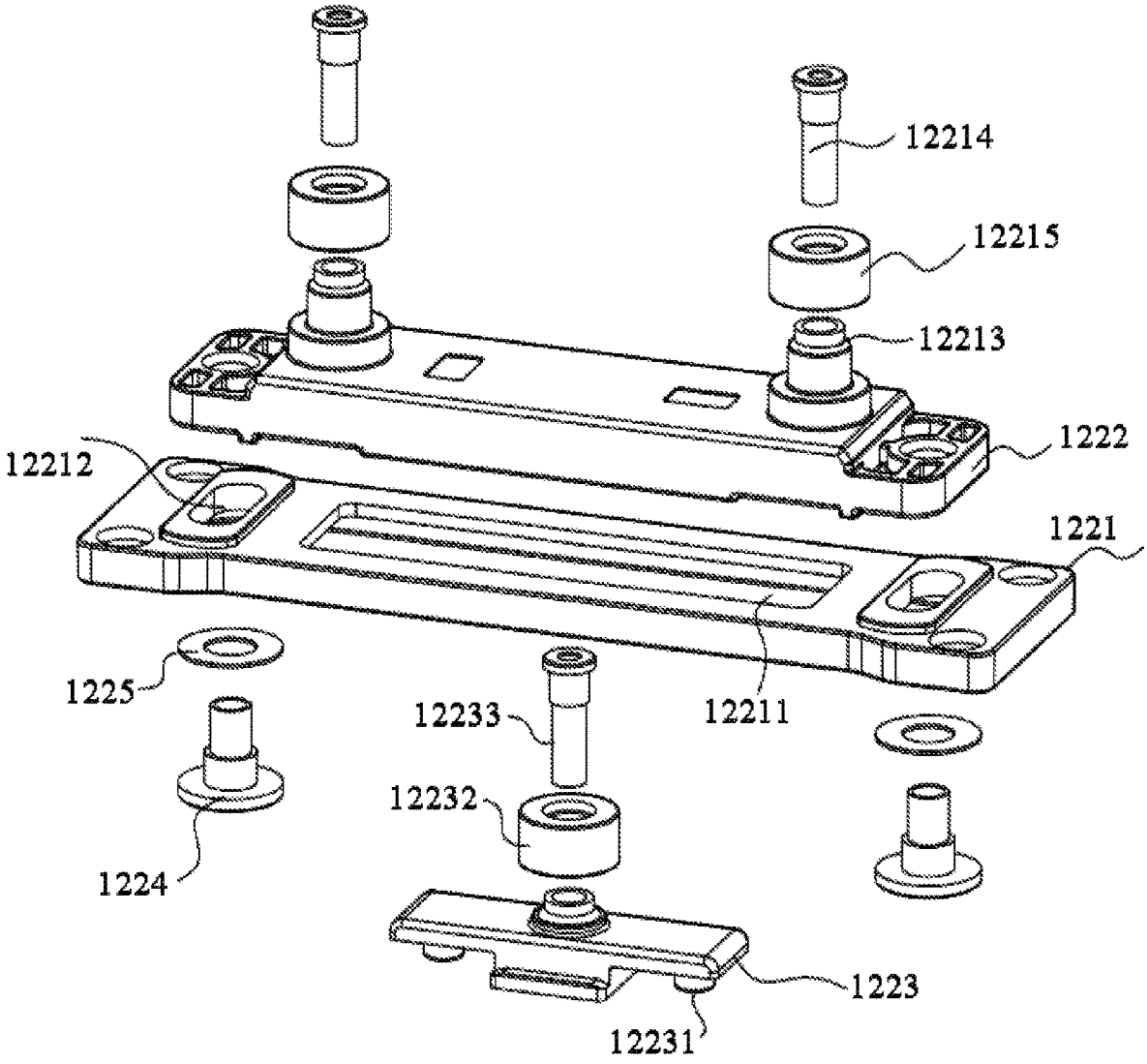
FIG. 10 is an exploded diagram illustrating the movable door-and-window assembly component above the movable door-and-window according to Embodiment 1 of the present application.
Figure 11:
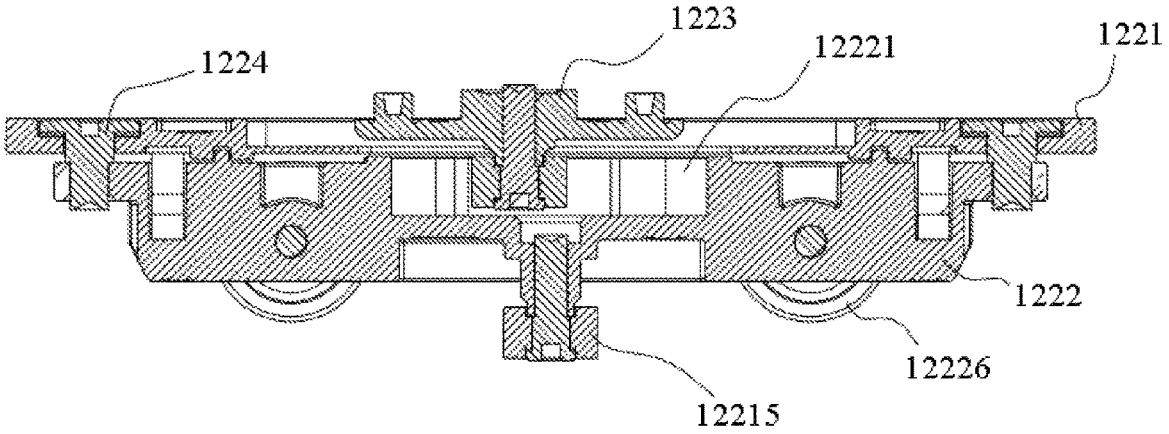
FIG. 11 is a cross-sectional view of the movable door-and-window assembly component below the movable door-and-window according to Embodiment 1 of the present application.
Figure 12:
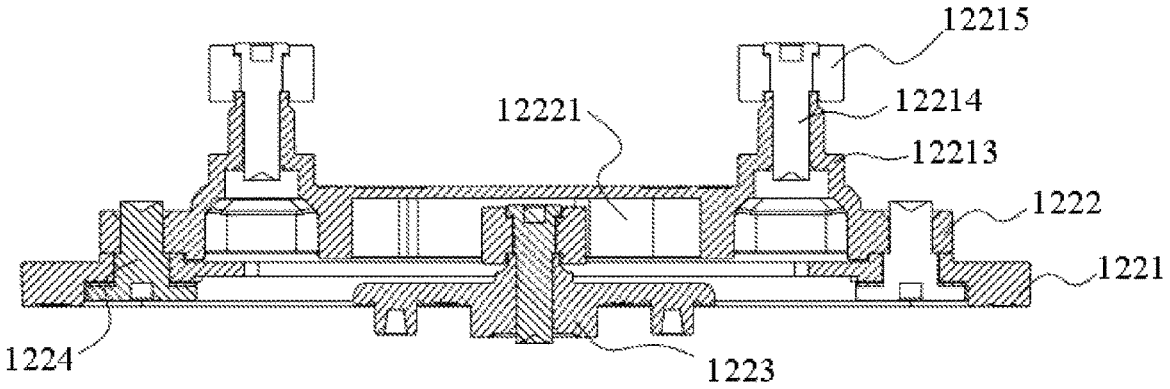
FIG. 12 is a cross-sectional view of the movable door-and-window assembly component above the movable door-and-window according to Embodiment 1 of the present application.
Figure 13:
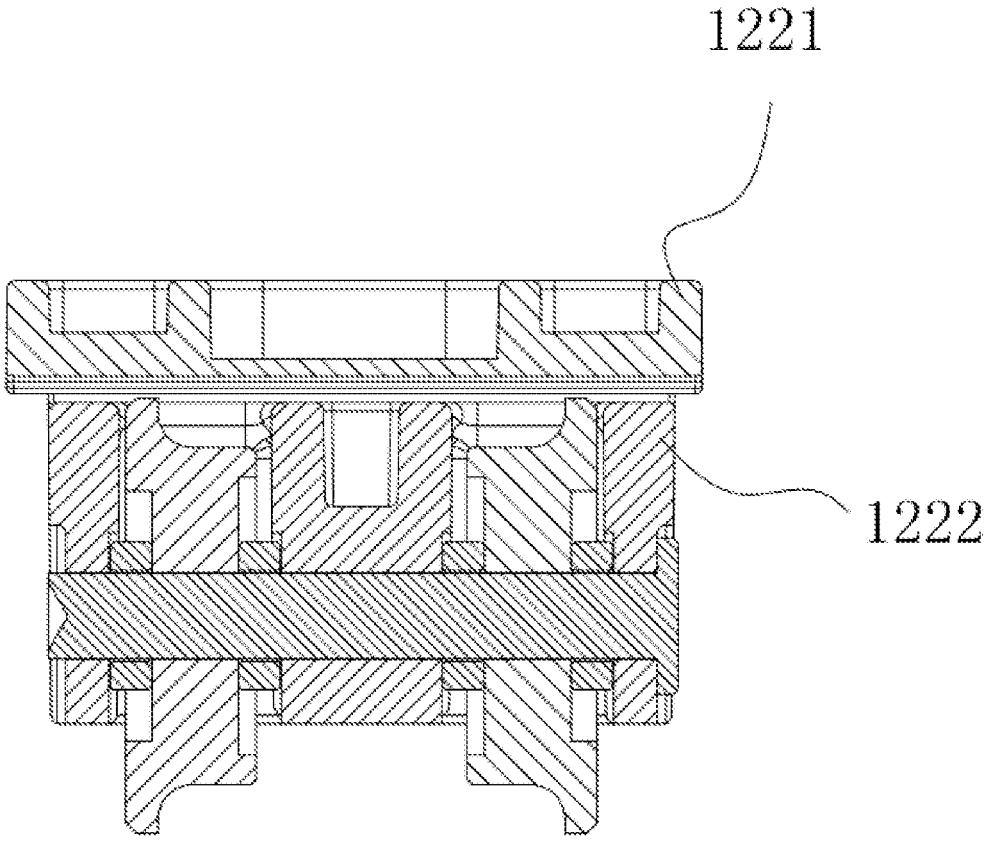
FIG. 13 is another cross-sectional view of the movable door-and-window assembly component below the movable door-and-window according to Embodiment 1 of the present application.
Figure 14:
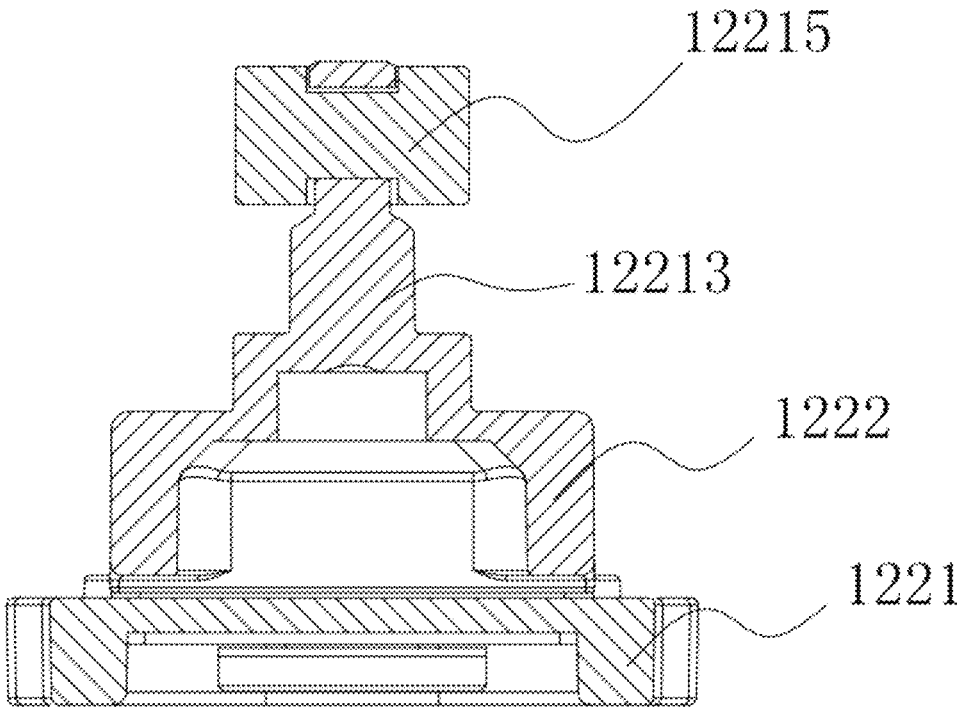
FIG. 14 is another cross-sectional view of the movable door-and-window assembly component above the movable door-and-window according to Embodiment 1 of the present application.

As shown in FIG. 2, the movable door-and-window transmission subsystem 12 includes: a handle component 121, a movable door-and-window assembly component 122 and a transmission component 123.

As shown in FIGS. 3 to 6, the door-and-window mounting profile 2 includes the following parts.

A main body 21, a rail disposed on the main body 21 and configured for the movable door-and-window 11 to move on, and a sealing member mounting portion 23 disposed on the main body 21 and spaced apart from the rail 22 by a predetermined distance, where the sealing member mounting portion 23 may be assembled with a corresponding sealing member 24. The sealing member 24 may be made of rubber or the like material.

The door-and-window mounting profile further includes: a door-and-window fixing portion disposed on the main body 21 at the side of the sealing member mounting portion 23 opposite to the rail 22 for mounting a fixed door-and-window 13.

In the embodiment, two types of movable door-and-window assembly components 122 are included, one above the movable door-and-window 11 and one below the movable door-and-window 11. The two movable door-and-window assembly components 122 each includes the structure described below, as illustrated in FIGS. 7 to 14.

A first base seat 1221, a second base seat 1222, a driving member 1223, and a guide member 1224, where the first base seat 1221 is configured to be assembled with the movable door-and-window 11 and the second base seat 1222 is configured to be movably assembled with the rail 22.

The first base seat 1221 is provided with: a first guide groove 12211 parallel to the rail 22, and the second base seat 1222 is provided with: a second guide groove 12221 that sits at a predetermined first angle $\alpha$ with the first guide groove 12211. A force receiving portion 12231 of the driving member 1223 is movably disposed in the first guide groove 12211, a driving portion 12232 of the driving member is movably disposed in the second guide groove 12221, and the force receiving portion 12231 and the driving portion 12232 are disposed on different sides of a driving shaft 12233 further included in the driving member 1223.

The first base seat 1221 is provided with a third guide groove 12212 that is perpendicular to a plane of the movable door-and-window 11 and that sits at a predetermined second angle (i with the second guide groove 12221, and the guide member 1224 is movably disposed in the third guide groove 12212 with one end of the guide member 1224 fixed to the second base seat 1222.

The driving member 1223, the guide member 1224, and the first base seat 1221 are set fast relative to the second base seat 1222 along a direction perpendicular to a plane determined by the first guide groove 12211 and the third guide groove 12212 so as not to be displaced in the direction of the plane perpendicular to the first guide groove 12211 and the third guide groove 12212, but they can be displaced in other directions. In other words, with the first base seat 1221 and the second base seat 1222 being set fast along the above-noted direction and the guide member 1224 providing the connection, restriction is implemented in the translation direction of the first base seat 1221 so that the first base seat 1221 can move in a direction defined by the arrangement.

The transmission component 123 is assembled with the handle component 121 and the force receiving portion 12231, respectively.

Thus, when the handle component 121 is operated, the force receiving portion 12231 would move along the first guide groove 12211 thanks to the force transmission effect of the transmission component 123, and at the same time the driving portion 12232 would move along the second guide groove 12221. Due to the assembly relationship between the guide member 1224 and the third guide groove 12212, the first base seat 1221 would translate relative to the second base seat 1222 along the direction of the third guide groove 12212, such that the movable door-and-window 11 would abut tightly against or move away from the sealing member 24 on the door-and-window mounting profile 2. Thus, while operating the handle for locking or unlocking, sealing or unsealing can be achieved between the movable door-and-window subsystem 1 and the door-and-window mounting profile 2, noise can be effectively reduced, and anti-shock performance can also be improved.

The transmission component 123 includes a plurality of transmission rods 1231 assembled with the force receiving portion 12231, and a conversion member 1232 that conducts force transmission between two transmission rods 1231 that are oppositely disposed and that extend in different directions.

In this embodiment, the conversion member 1232 includes an angular actuator 12321 configured for conducting force transmission between two transmission rods 1231 that are perpendicular to each other, and/or a translation actuator 12322 for conducting force transmission between two transmission rods 1231 that are parallel to each other. The angular actuator 12321 may be provided with an arced piece and a guide through groove. One end of the arced piece is assembled with or abuts one of the transmission rods 1231, and the other end is assembled with or abuts another transmission rod, such that force transmission can be achieved between two transmission rods 1231 that are perpendicular to each other. Two parallel pull rods and a connecting rod between the pull rods may be provided in the translation actuator 12322. One pull rod is assembled with one transmission rod 1231, and the other pull rod is assembled with another transmission rod 1231, such that force transmission between two transmission rods 1231 that are parallel to each other can be achieved.

The handle component 121 includes: a handle 1211 and an actuator 1212 assembled with each other. The movable door-and-window transmission subsystem 12 further includes: a lock 124 disposed on the side of the handle component 121 and/or on the side of the movable door-and-window 11 opposite to the handle component 121 and disposed between two of the transmission rods 1231. The lock 124 may include a lock point 1241 and a lock seat 1242 that cooperate to achieve locking or unlocking.

Figure 15:
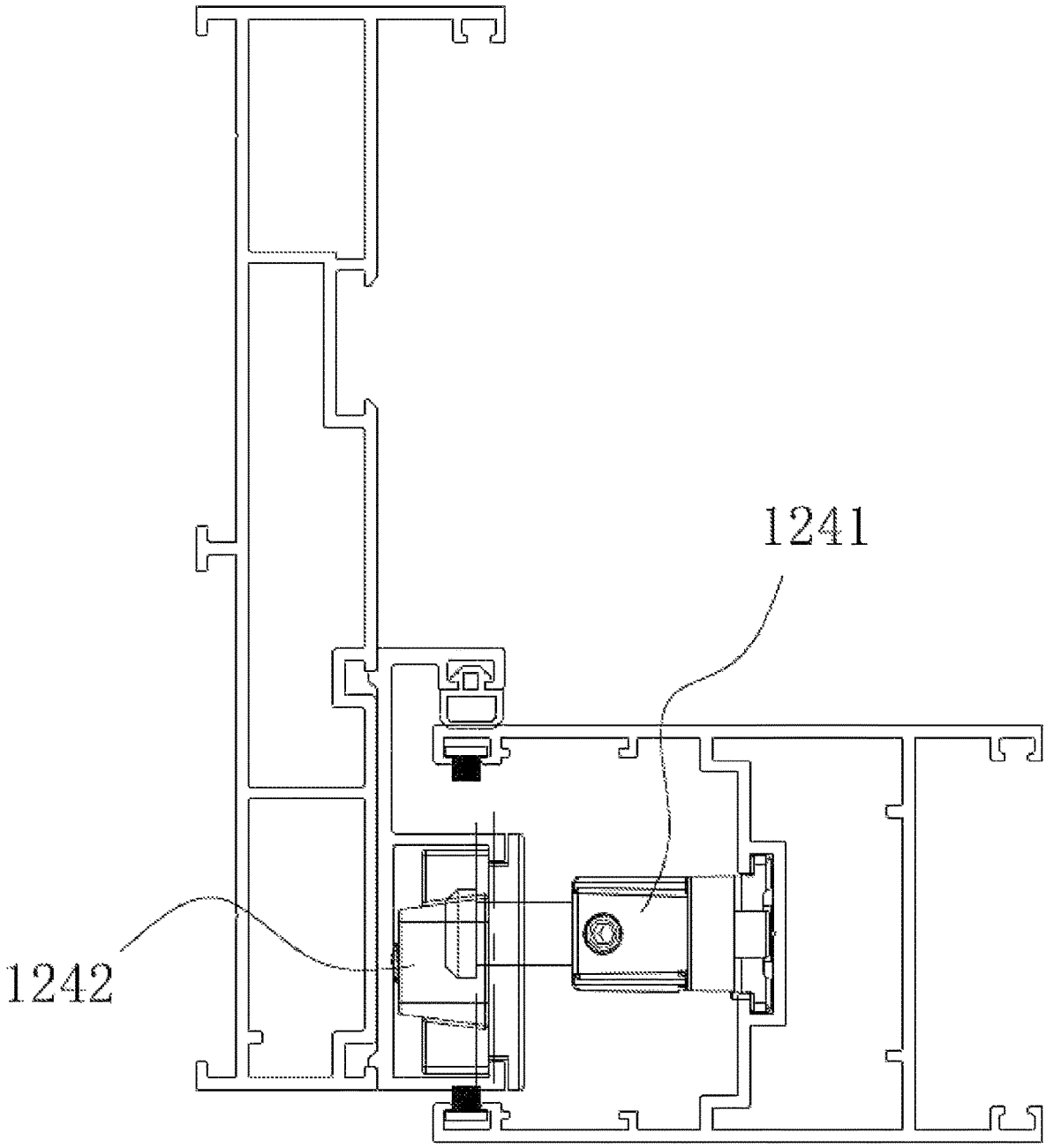
FIG. 15 is a first schematic diagram illustrating the movable door-and-window and a fixed door-and-window in a locked mode according to Embodiment 1 of the present application.
Figure 16:
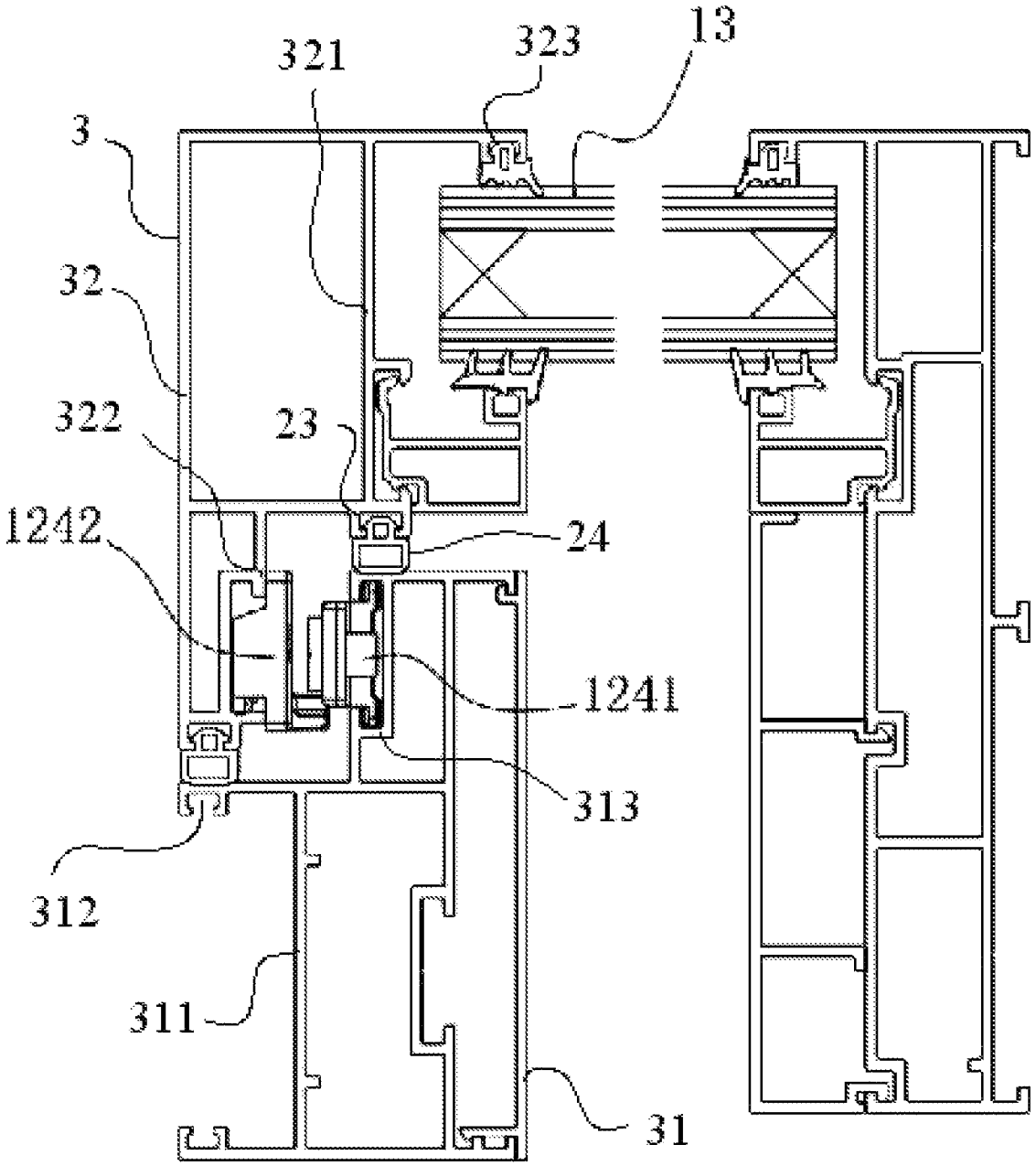
FIG. 16 is a second schematic diagram illustrating the movable door-and-window and the fixed door-and-window in the locked mode according to Embodiment 1 of the present application.

Thus, when the handle component 121 is operated, thanks to the force transmission of the transmission component 123, the movable door-and-window 11 can not only accomplish the locking of the door-and-window mounting profile 2 on the side of the handle component 121, as shown in FIG. 15, but also complete the locking between the lock point 1241 on the movable door-and-window 11 on the opposite side of the handle component 121 and the lock seat 1242 on the door-and-window mounting profile 2, as illustrated in FIG. 16, thereby ensuring a close assembly between the movable door-and-window subsystem 1 and the door-and-window mounting profile 2. Thus, during high winds or vibrations, no relative movement that generates noise would occur between the movable door-and-window subsystem 1 and other components, and the anti-shock performance would be improved as well.

Referring further to FIG. 16, the embodiment further relates to a door-and-window combining profile 3, including: a first assembly profile 31 and a second assembly profile 32 without the handle 121 mounted for mounting the movable door-and-window 11. The first assembly profile 31 includes: a first base body 311, a first door-and-window assembly portion 312 disposed on the first base body 311 for assembling the movable door-and-window 11, and a first lock assembly portion 313 disposed on the first base body 311 and configured for assembling the locking point 1241.

The second assembly profile 32 includes: a second base body 321 and a second lock assembly portion 322 disposed on the second base body 321, where the second lock assembly portion 322 corresponds to the first lock assembly portion 313 and is configured for assembling the locking seat 1242.

The second assembly profile 32 further includes the sealing member mounting portion 23 configured for sealing when tightly abutting the first assembly profile 31, and the sealing member mounting portion 23 may be mounted with the sealing member 24.

The second assembly profile 32 further includes a second assembly portion 323 disposed on the second base body 321 for assembling a second door-and-window (the fixed door-and-window 13 or the movable door-and-window).

In the movable door-and-window assembly component 122 described below, the second base seat 1222 is provided with: a bearing rotating shaft 12222, and a rolling bearing 12223 that includes an inner ring sleeved on the bearing rotating shaft 12222 and an outer ring abutting against the first base seat 1221, where the rolling bearing 12223 is axially parallel to the rail 22.

Thus, the second base seat 1222 contacts the first base seat 1221 via the rolling bearing 12223, the friction generated by the relative movement between the second base seat 1222 and the first base seat 1221 is rolling friction. Since rolling friction has a small friction coefficient, the relative movement between the second base seat 1222 and the first base seat 1221 can be achieved by operating the handle 1211 without needing to exert a relatively large force.

The second base seat 1222 is provided with a support piece 12224 that abuts the outer ring of the rolling bearing 12223.

The force receiving portion 12231 is disposed on the side of the first guide groove 12211 opposite to the second base seat 1222 and has a larger size than the first guide groove 12211 through which the driving shaft 12233 extends, and the driving portion 12232 is disposed on the side of the first guide groove 12211 opposite to the first base seat 1221 and has a larger size than the first guide groove 12211.

One end of the guide member 1224 extends through the third guide groove 12212 and is then fixed to the second base seat 1222, and another end of the guide member is disposed on the side of the third guide groove 12212 opposite to the second base seat 1222 and has a larger size than the third guide groove 12212.

A gasket 1225 is further disposed between the end of the guide member 1224 having a larger size than the third guide groove 12212 and the third guide groove 12212.

The second base seat 1222 is provided with a bearing wheel rotating shaft 12225, and a bearing wheel 12226 that is sleeved on the bearing wheel rotating shaft 12225 and that abut against the rail 22. The bearing wheel 12226 is axially perpendicular to the rail 22.

The first base seat 1221 and the second base seat 1222 are each provided with: a mounting portion 12213, a guide shaft 12214, and a guide portion 12215, where the guide portion 12215 is mounted with the mounting portion 12213 via the guide shaft 12214 and is movably assembled with the rail 22. The guide portion 12215 and the driving portion 12232 are each a wheel body, where the wheel body is rotatable around the guide shaft 12214 or the driving shaft 12233. A washer 12227 is further disposed between the bearing wheel 12226 and the second base seat 1222.

Embodiment 2

The difference between this embodiment and other embodiments mainly lies in the following.

In this embodiment, the second base seat 1222 is configured to be assembled with the movable door-and-window 11 and be movably assembled with the rail 22.

Embodiment 3

The difference between this embodiment and other embodiments mainly lies in the following.

In this embodiment, the second base seat 1222 is provided with the third guide groove 12212 that is perpendicular to a plane of the movable door-and-window 11 and that sits at a predetermined second angle 3 with the second guide groove 12221, and the guide member 1224 is movably disposed in the third guide groove 12212 with one end of the guide member 1224 fixed to the first base seat 1222.

Embodiment 4

The difference between this embodiment and other embodiments mainly lies in the following.

In this embodiment, the conversion member 1232 includes the angular actuator 12321 configured for conducting force transmission between two transmission rods 1231 that are perpendicular to each other, and do not include the translation actuator 12322.

Embodiment 5

The difference between this embodiment and other embodiments mainly lies in the following.

In this embodiment, the movable door-and-window transmission subsystem 12 further includes: the lock 124 disposed on one side of the handle component 121 or on one side of the movable door-and-window 11 opposite to the handle component 121 and disposed between two of the transmission rods 1231.

Embodiment 6

The difference between this embodiment and other embodiments mainly lies in the following.

In this embodiment, the first base seat 1221 is provided with: the bearing rotating shaft 12222, and the rolling bearing 12223 that includes an inner ring is sleeved on the bearing rotating shaft 12222 and an outer ring abutting on the second base seat 1222, where the rolling bearing 12223 is axially parallel to the rail 22. The second base seat 1222 is provided with the support piece 12224 that abuts the outer ring of the rolling bearing 12223.

Embodiment 7

The difference between this embodiment and other embodiments mainly lies in the following.

In this embodiment, when the second base seat 1222 is provided with the third guide groove 12212, one end of the guide member 1224 extends through the third guide groove 12212 and is then fixed to the first base seat 1221, and the other end of the guide member is disposed on the side of the third guide groove 12212 opposite to the first base seat 1221 and has a larger size than the third guide groove 12212.

Embodiment 8

The difference between this embodiment and other embodiments mainly lies in the following.

In this embodiment, when the first base seat 1221 is configured to be movably assembled with the rail 22, the first base seat 1221 is provided with the bearing wheel rotating shaft 12225, and the bearing wheel 12226 that is sleeved on the bearing wheel rotating shaft 12225 and that abuts against the rail 22, where the bearing wheel 12226 is axially perpendicular to the rail 22.

Embodiment 9

The difference between this embodiment and other embodiments mainly lies in the following.

In this embodiment, the first base seat 1221 or the second base seat 1222 is optionally provided with the mounting portion 12213, the guide shaft 12214, and the guide portion 12215.

Embodiment 10

The difference between this embodiment and other embodiments mainly lies in the following.

In this embodiment, the guide portion 12214 or the driving portion 12232 is a wheel body, and the wheel body is rotatable around the guide shaft 12214 or the driving shaft 12233.

Embodiment 11

The difference between this embodiment and other embodiments mainly lies in the following.

In this embodiment, when the first base seat 1221 is configured to be movably assembled with the rail 22, the washer 12227 is further disposed between the bearing wheel 12226 and the first base seat 1221.

Other embodiments requiring explanation or for reference are described below.

The above-mentioned rail may be integrally formed with the main body 21 or combined therewith in a split manner. The door-and-window fixing portion may be integrally formed with the main body 21 or combined therewith in a split manner. The sealing member mounting portion 23 may be integrally formed with the main body 21 or combined therewith in a split manner. The above cases are optional. The first assembly profile 31 may be integrally formed or splitly combined, and the second assembly profile 32 may be integrally formed or splitly combined. The first lock assembly portion 313 may be a lock seat assembly portion, and the second lock assembly portion 322 may be a lock point assembly portion. The first assembly profile 31 may further include the sealing member mounting portion 23. The sealing member mounting portion 23 is configured for sealing when tightly abutting on the second assembly profile 32 and may be mounted with the sealing member 24.

Throughout the specification, reference terms "an implementation", "some implementations", "an embodiment", "some embodiments", "example", "specific examples", "some examples" or the like mean that a specific characteristic, structure, material, or feature described in connection with the embodiment or example are included in at least one embodiment or example of the present application. In the specification, the schematic representation of the above terms does not necessarily refer to the same embodiment or example. Furthermore, the specific characteristics, structures, materials, or features described herein may be combined as appropriate in one or more embodiments or examples.

The foregoing is a detailed description of the present application in conjunction with the specific embodiments, such that the specific implementations of the present application will not be limited to this specification. For those of ordinary skill in the art to which the present application pertains, a number of simple deductions or substitutions may be made without departing from the concept of the present application.

What is claimed is:

1. A door system, comprising:

a movable door subsystem; and a door mounting profile;

wherein the movable door subsystem comprises a movable door and a movable door transmission subsystem, the movable door transmission subsystem comprising a handle assembly, a movable door assembly component, and a transmission component;

wherein the door mounting profile comprises a main body, a rail disposed on the main body and configured for supporting the movable door as the movable door moves along the rail, and a sealing member mounting portion disposed on the main body and spaced apart from the rail by a predetermined distance;

wherein the movable door assembly component comprises a first base seat, a second base seat, a driving member, and a guide member, wherein the first base seat has a first guide slot having a longitudinal axis parallel to a longitudinal axis of the rail, the second base seat has a second guide slot that has a longitudinal axis that forms a predetermined first angle with the longitudinal axis of the first guide slot, wherein the first base seat is configured to be connected to the movable door and the second base seat is configured to be movably engaged with the rail; wherein the driving member comprises a force receiving portion movably disposed in the first guide slot, a driving portion movably disposed in the second guide slot, and a driving shaft; wherein the force receiving portion and the driving portion are disposed on opposite ends of the driving shaft;

wherein the first base seat is provided with a third guide slot that has a longitudinal axis that is perpendicular to the longitudinal axis of the first guide slot and that forms a predetermined second angle with the longitudinal axis of the second guide slot, and the guide member is disposed in and movable along the longitudinal axis of the third guide slot with one end of the guide member fixed to the second base seat; and wherein the driving member is immovable relative to the first base seat along a direction perpendicular to the longitudinal axis of the first guide slot in a plane defined by the first base seat and the first base seal is immovable relative to the second base seat along a direction parallel to the longitudinal axis of the first guide slot, and the transmission component is connected with the handle assembly and the force receiving portion.

2. The door system of claim 1, wherein the transmission component comprises a plurality of transmission rods connected to the force receiving portion, and a conversion member that conducts force transmission between at least two of the transmission rods.

3. The door system of claim 2, wherein the conversion member is selected from the group consisting of an angular actuator configured for conducting force transmission between at least two adjacent transmission rods that run perpendicular to each other, and a translation actuator configured for conducting force transmission between at least two adjacent transmission rods that run parallel to each other.

4. The door system of claim 2, wherein the handle assembly comprises a handle and an actuator, and wherein the movable door transmission subsystem further comprises a lock disposed adjacent the handle assembly.

5. The door system of claim 1, wherein the second base seat is provided with a bearing rotating shaft, and a rolling bearing that comprises an inner ring sleeved on the bearing rotating shaft and an outer ring abutting against the first base seat, wherein the rolling bearing is axially parallel to the longitudinal axis of the rail.

6. The door system of claim 5, wherein the second base seat is provided with a support piece that abuts against the outer ring of the rolling bearing.

7. The door system of claim 1, wherein the force receiving portion is disposed on a first side of the first guide slot opposite to the second base seat, the driving shaft extends through the first guide slot, and the driving portion is disposed on a second side of the first guide slot opposite to the first side of the first guide slot.

8. The door system of claim 1, wherein the guide member extends through the third guide slot and a first end of the guide member is fixed to the second base seat, and a second end of the guide member is disposed on a side of the third guide slot opposite to the second base seat;

wherein a gasket is disposed between the second end of the guide member and the third guide slot.

9. The door system of claim 1, wherein the second base seat is provided with a bearing wheel rotating shaft, and a bearing wheel that is sleeved on the bearing wheel rotating shaft and that abuts against the rail, with the bearing wheel rotating shaft axially perpendicular to the longitudinal axis of the rail.

10. The door system of claim 1, wherein the second base seat is provided with a mounting portion, a guide shaft, and a guide portion, wherein the guide portion is assembled to the mounting portion via the guide shaft and is movably engageable with the rail; the guide portion is a wheel body, and the wheel body is rotatable around the guide shaft.

* * * * *